US006537094B2

(12) United States Patent
McCoy et al.

(10) Patent No.: US 6,537,094 B2
(45) **Date of Patent: *Mar. 25, 2003**

(54) ELECTRICAL TERMINAL BLOCK AND RECEPTACLES

(75) Inventors: Phillip A. McCoy, Albion, IN (US); Shawn J. Kondas, Kendallville, IN (US)

(73) Assignee: Pent Asemblies, Inc., Kendallville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/918,061

(22) Filed: Jul. 30, 2001

(65) Prior Publication Data

US 2001/0046806 A1 Nov. 29, 2001

Related U.S. Application Data

(63) Continuation of application No. 09/307,115, filed on May 7, 1999, now Pat. No. 6,267,613.

(51) Int. Cl.[7] ..... H01R 13/52
(52) U.S. Cl. ..... 439/281; 439/723
(58) Field of Search ..... 439/281, 218, 439/207, 215, 688, 214, 223, 224, 535, 465

(56) References Cited

U.S. PATENT DOCUMENTS

| | | | | |
|---|---|---|---|---|
| 4,148,546 A | * | 4/1979 | Wilson et al. | 439/743 |
| RE31,033 E | | 9/1982 | Wilson, Jr. et al. | 439/743 |
| 4,462,656 A | | 7/1984 | Beyer | 339/154 A |
| 4,740,167 A | * | 4/1988 | Millhimes et al. | 439/92 |
| 5,203,711 A | * | 4/1993 | Boogiel | 439/215 |
| 5,542,860 A | * | 8/1996 | Bandura | 439/567 |

* cited by examiner

*Primary Examiner*—P. Austin Bradley
*Assistant Examiner*—Phuongchi Nguyen
(74) *Attorney, Agent, or Firm*—Taylor & Aust, P.C.

(57) ABSTRACT

This invention is directed to an electrical distribution terminal block and modularly couplable electrical receptacles wherein the terminal block is formed by a plurality of stackable wafers. Each wafer has upper channels formed therein that radiate from a common upper interior intersection point to an outer surface thereof, and lower channels formed therein that radiate from a common lower interior intersection point to an outer surface thereof. When the wafers are vertically stacked, the upper channels of one wafer complementally form ducts with the lower channels of another wafer, each duct having an outlet or port in communication with the exterior of the terminal block. An electrical terminal, formed in a configuration adapted to be received in the upper or lower channels, is disposed in each formed duct and includes connectors for coupling to incoming and outgoing wires of a polarity including neutral, and for coupling that polarity or neutral to a terminal of the receptacle. Each electrical receptacle includes projections that house outlet terminals, the projections received in the appropriate ports of the ducts.

5 Claims, 6 Drawing Sheets

ELECTRICAL TERMINAL BLOCK AND RECEPTACLES

This is a continuation of application Ser. No. 09/307,115 filed May 7, 1999 now U.S. Pat. No. 6,267,613.

BACKGROUND OF THE INVENTION

1. Field of the Invention

The present invention relates to electrical receptacles and, more particularly, to an electrical terminal block and couplable electrical receptacles.

2. Description of the Related Art

Electrical receptacles or outlets are well known as a means for providing an interface between a supply or source of electricity and an appliance, tool, equipment, or the like. Such receptacles come in a variety of plug configurations, most of which are standardized according to the type of use. For instance, most people are familiar with the standard household receptacle which has two slots and a round or D-shaped ground opening.

Because of the proliferation of electrical equipment, electrical outlets or receptacles must be provided almost everywhere. This is especially true in the workplace, where computers, printers, facsimile machines, telephones, and the like must be connected to an electrical outlet. Also, the workplace has evolved to where there is more than just the conventional type of furniture. Now there are modular units, cubicles and the like which may be located away from walls and other structures where electrical receptacles/outlets are traditionally located. In this type of office furniture, electrical receptacles are typically located along the bottom or side rails of the support structures.

However, since there needs to be plenty of electrical receptacles to handle the myriad of office equipment needing electricity, wiring is a problem. Further, there is a need for greater flexibility in locating and configuring the needed electrical receptacles. As well, accessibility of the outlets is a concern.

SUMMARY OF THE INVENTION

The present invention is a terminal block for the distribution of electricity to electrical receptacles or outlets.

In one form the present invention is a stackable terminal block for the distribution of electricity to electrical receptacles. The terminal block is formed by a plurality of stackable wafers. The wafers retain terminals therebetween that distribute the electricity. Each terminal accommodates one wire of the electrical cable, which also couples to one portion of the electrical receptacle/outlet. Several receptacles may be modularly coupled to the terminal block.

Essentially each wafer has upper channels formed therein that radiate from a common upper interior intersection point to an outer surface thereof, and lower channels formed therein that radiate from a common lower interior intersection point to an outer surface thereof. When the wafers are vertically stacked, the upper channels of one wafer complementally form ducts with the lower channels of another wafer, each duct having an outlet or port in communication with the exterior of the terminal block. An electrical terminal, formed in a configuration adapted to be received in the upper or lower channels, is disposed in each formed duct and includes connectors for incoming and outgoing wires of a certain polarity, and for coupling to a terminal of an electrical receptacle. Each electrical receptacle includes projections that house outlet terminals, the projections received in the appropriate ports of the ducts.

According to an aspect of the present invention, the modular electrical receptacles can be plugged into the terminal block in any number, and can have terminals configured in any manner to accommodate the wiring of the terminal block.

It is an advantage of the present invention that the configuration of the terminal block may be varied.

It is another advantage of the present invention that several terminal blocks may be electrically coupled, generally in a vertical relationship, for a plurality of electrical receptacles along a column or post.

It is yet another advantage of the present invention that the terminal block may be adapted for one or a plurality of electrical receptacles.

It is further an advantage of the present invention that building blocks or wafers of the terminal block may be varied for any number of wires and/or outlets.

It is still further an advantage of the present invention that the terminal block can accommodate or be interchangeable for any configuration of line polarity including neutral for any terminal.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplification set out herein illustrate a preferred embodiment of the invention, in one form, and such exemplification is not to be construed as limiting the scope of the invention in any manner.

DETAILED DESCRIPTION OF THE INVENTION

Figure 1:
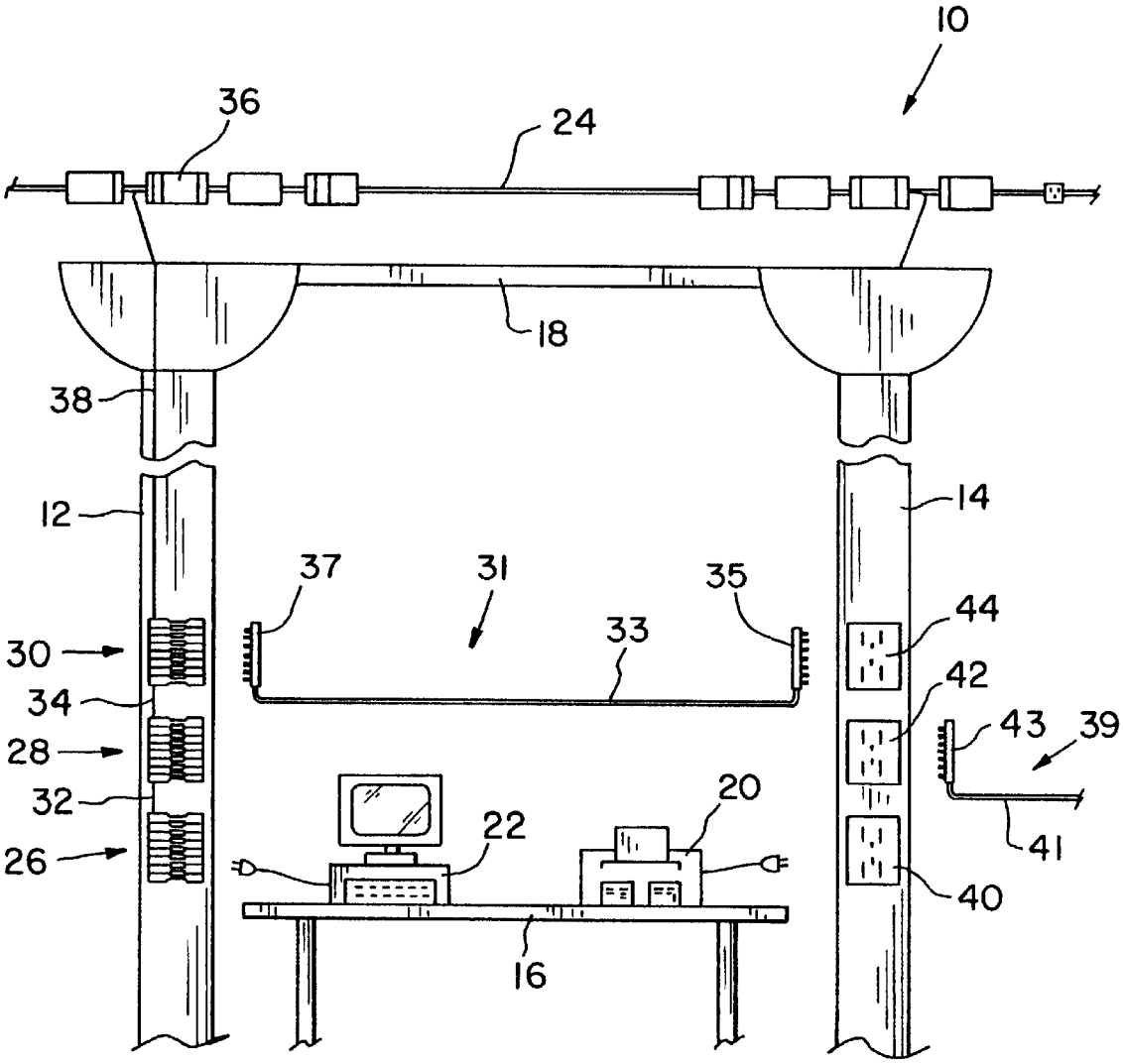
FIG. 1 is a front perspective view of a piece of furniture having vertical support posts with two of the posts having vertically disposed terminal blocks/electrical receptacles therein in accordance with an aspect of the present invention, each terminal block electrically coupled to a source of electricity.

Referring now to the drawings and more particularly to FIG. 1, there is shown furniture 10 supported by vertical column or post 12 on one side of table or platform 16 and vertical column or post 14 on another side of table 16. It should be understood that furniture 10 is representative of any type of furniture, but especially free-standing modular or cubicle office furniture that is supported or incorporates vertical posts, columns, or legs. Extending between posts 12 and 14 is horizontal beam 18 which carries electrical cable 24 therein that is generally coupled to an electrical junction box or the like (not shown) for supplying electricity. Electrical cable 24 may be a typical electrical supply cable that carries three conductors; a ground wire/conductor, a positive wire/conductor, and a negative wire/conductor, or the like, of which is known in the art. Table 16 is shown supporting telephone 20 and computer 22 which require connection to an electrical receptacle or outlet.

In accordance with an aspect of the present invention, the interior of post 12 contains terminal blocks 26, 28, and 30 in vertical relationship to one another. Terminal block 30 is in electrical communication with electrical cable 24 via electrical cable 38, which typically includes three wires, and junction box or connector 36 which is disposed in horizontal beam 18. Electrical cable 24 is wired to junction box 36 in a manner known in the art, while electrical cable 38 is wired as well at one end to junction box 36. Junction box 36 can also function as a terminal box for a ceiling outlet. The other end of electrical cable 38 is received by terminal block 30 as detailed below. Electrical cable 34, again which typically includes three wires ("+", "−", and neutral), is electrically coupled at one end to terminal block 30 and electrically coupled at its other end to terminal block 28. Electrical cable 32, again which typically includes three wires, is electrically coupled at one end to terminal block 28 and electrically coupled at its other end to terminal block 26. In this manner, electricity is supplied from electrical supply cable 24 to each terminal block 26, 28, and 30. It should here be understood that the number of terminal blocks disposed within a post or column is variable. Thus, only one terminal block may be disposed within the post or as many terminal blocks as can fit within the post may be used. Of course, the number of terminal blocks will be limited by the capacity of the electrical supply.

Post 14 has a first set of electrical outlets 40 that correspond and electrically couple to terminal block 26, a second set of electrical outlets 42 that correspond and electrically couple to terminal block 28, and a third set of electrical outlets 44 that correspond and electrically couple to terminal block 30. In general, one electrical outlet per terminal block is disposed on one face of the post. It should be understood that post 12 depicts what is disposed within the interior thereof and thus would include exterior electrical receptacles as shown on post 14. At the same time, post 14 depicts the exterior electrical receptacles mountable to the interior terminal blocks that are not seen, but as depicted with regard to post 12.

Additionally depicted in FIG. 1 is beltline jumper 31 comprised of electrical cable 33 terminating at one end in connector 35 and terminating at the other end in connector 37. Connectors 35 and 37 are configured to be received by one side of a terminal block or receptacle thereof. Beltline jumper 31 may be used to electrically couple one terminal block with another terminal block, each terminal block generally disposed in different posts, and is generally used at table level. Thus, if overhead power is not supplied to each post, beltline jumper 31 may be used to supply power from a terminal block having power to another terminal block not having power. Also depicted in FIG. 1 is floor power entry assembly 39 comprising electrical cable 41 terminating in connector 43. Again, connector 43 is configured to be coupled to or received by one side of a terminal block. Floor power entry assembly 39 may be used at floor level to provide power from a power source (not shown) to a terminal block, again if overhead power is not utilized. Also, assembly 39 may be used as a jumper to connect other terminal blocks of other posts at floor level. Assembly 39 may be used in conjunction with beltline jumper 31.

Figure 2:
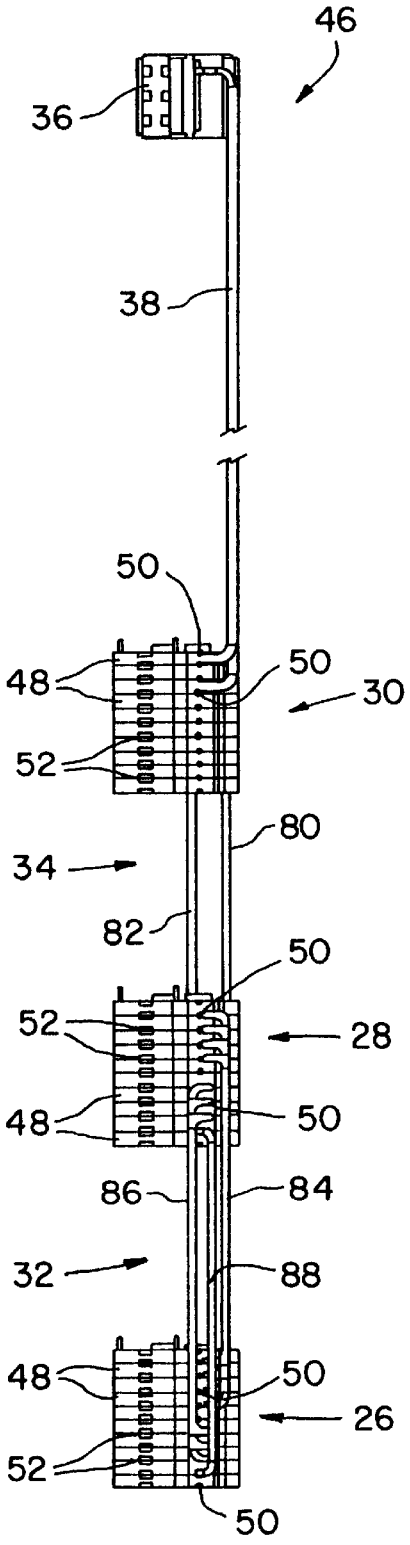
FIG. 2 is an enlarged side view of one of the vertically disposed terminal blocks from one of the posts of FIG. 1.

With reference now to FIG. 2, there is shown vertically disposed terminal block stack generally designated 46 as depicted within post 12 of FIG. 1. Each terminal block 26, 28, and 30 is formed in part by a plurality of vertically stacked or axially adjacent wafers 48. The number of axially adjacent wafers 48 depends on the desired electrical receptacle/outlet interface configuration. An exemplary coupling of the electricity supply from cable 38 is depicted. The individual conductors of electrical cable 38 are electrically coupled at one end to junction box 36 and extend to terminal block 30. The other ends of the individual conductors of cable 38 are received in separate wire ports 50 on one side of terminal block 30. The wire ports 50 are formed between axially adjacent wafers 48 and define a plane. Each plane is between axially adjacent wafers 48, and is dedicated to the particular electrical polarity of the incoming wire/conductor, including ground, associated with the particular port. This includes line, neutral and ground. Further, because of this configuration, any port may be interchanged to accept whatever line or neutral wire as may be needed, as long as the electrical receptacle supports the particular configuration. With a conventional three-wire conductor, one wire would be received in one wire port, another wire would be received in another wire port, while the last wire would be received in yet another wire port. The three incoming wires are electrically coupled to an electrical receptacle as further explained below. Preferably, the wires are coupled to wire ports that are axially adjacent. The incoming wires feed an upper portion of terminal block 30 which correspond to the upper outlet of an attached or coupled electrical receptacle.

Additionally, there are separate wire ports (not seen), one each, for any exiting wire/conductor on another side of terminal block 30. The exiting wires/conductors couple to other wire ports of the same terminal block for supplying electricity to the lower outlet of a coupled electrical receptacle and/or of the upper or lower portion of a different terminal block. In FIG. 2, electrical cable 34 as depicted in FIG. 1, comprises electrical cable 80 and electrical cable 82. Cables 80 and 82 typically have three conductors and are used to distribute the electricity received by terminal block 30 via electrical cable 38.

While not seen in FIG. 2, the electricity that is received into the upper portion of terminal block 30 by cable 38, which feeds the upper outlet of an attached electrical receptacle, is distributed into the lower portion of terminal block 30, which feeds the lower outlet of an attached electrical receptacle. The three conductors of cable 80 exit from wire ports on one side of terminal block 30 and are electrically coupled to either the upper or lower portion wire ports on terminal block 28. In like manner, the three conductors of cable 82 exit from wire ports on another side of terminal block 30 and are electrically coupled to the other of either the upper or lower portion wire ports on terminal block 28. Cable 32 as depicted in FIG. 1, is shown three cables 84, 86, and 88. Cable 84 consists of three wires or conductors that distribute the electricity from the upper portion of terminal block 28 to the upper portion of terminal block 26 via appropriate wire ports 50. Cable 86 also consists of three wires or conductors and distribute the electricity from the lower portion terminal block 28 to the lower portion of terminal block 26. Cable 88 consists of a single wire or conductor and is used to connect ground. It should be understood that the connection scheme described above and depicted in FIG. 2 is only exemplary. The manner and place of connection (relative to one wire port or another) is arbitrary.

Figure 3:
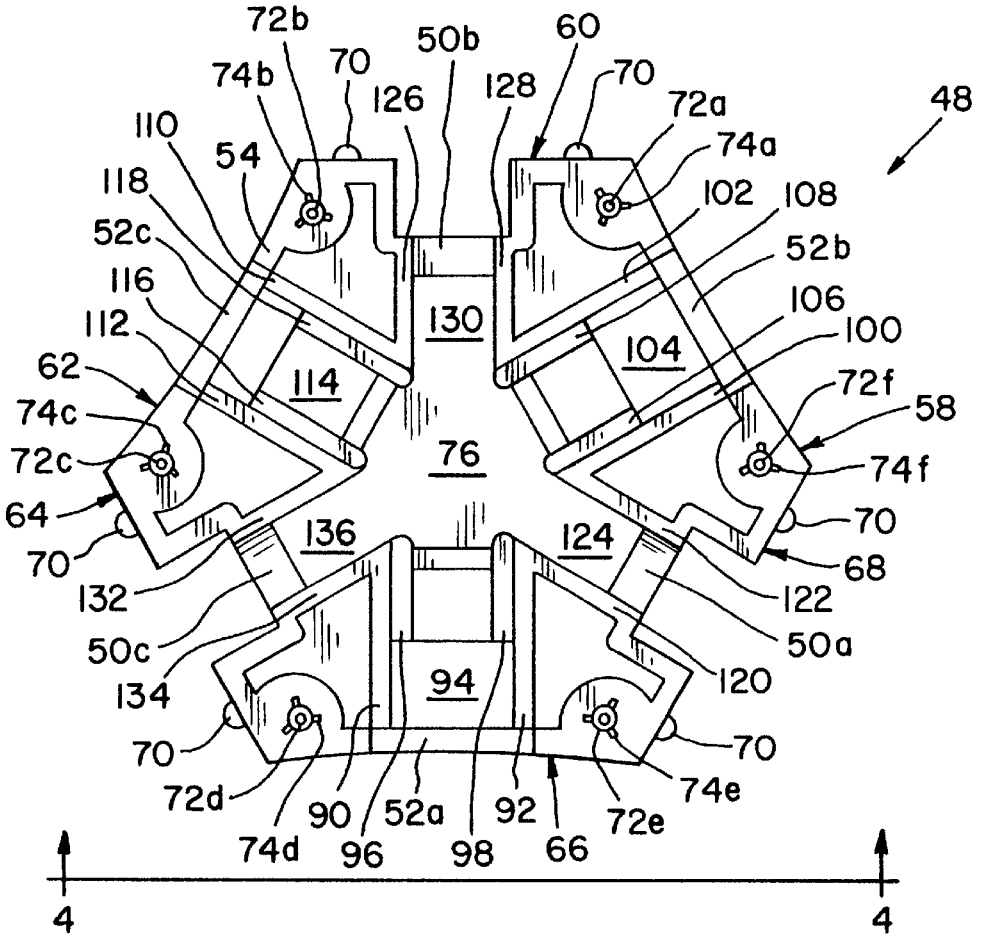
FIG. 3 is a top plan view of a wafer of a terminal block in accordance with the present invention.
Figure 4:
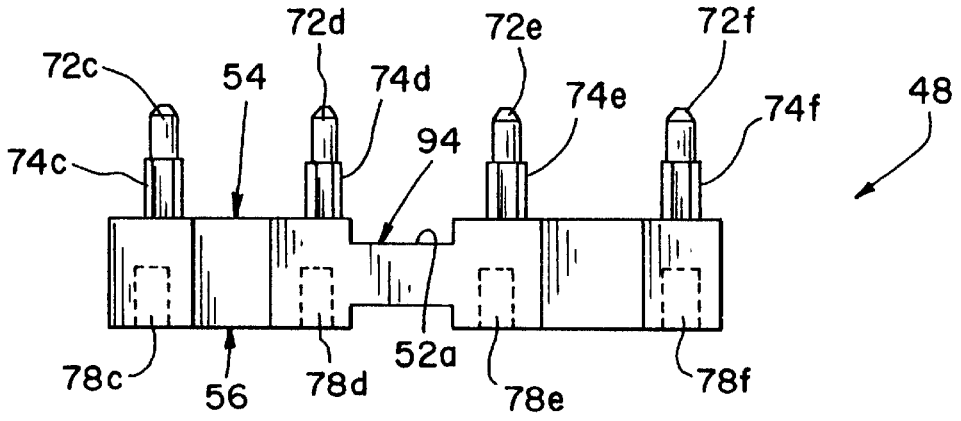
FIG. 4 is a side view of the wafer of FIG. 3 taken along line 4—4 thereof.

With reference now to FIGS. 3 and 4, a wafer 48 is depicted. Wafer 48 is made from an electrically insulating material such as plastic, and may be molded or made in a conventional manner. As each wafer of a terminal block is identical, only one such wafer 48 is depicted in FIGS. 3 and 4. Wafer 48 defines an upper surface 54 and a lower surface 56, and has six (6) sides 58, 60, 62, 64, 66, and 68. Sides 60, 64, and 68 include radially extending knobs 70. Posts 72*a*, 72*b*, 72*c*, 72*d*, 72*e*, and 72*f* axially extend from upper surface 54 and are disposed on each corner between sides 58, 60, 62, 64, 66, and 68. Posts 72*a*, 72*b*, 72*c*, 72*d*, 72*e*, and 72*f* have respective flanges 74*a*, 74*b*, 74*c*, 74*d*, 74*e*, and 74*f* on a lower portion thereof such that the diameter of flanges 74*a*, 74*b*, 74*c*, 74*d*, 74*e*, and 74*f* are slightly greater than the diameter of their respective posts 72*a*, 72*b*, 72*c*, 72*d*, 72*e*, and 72*f*.

With regard to the topography of upper surface 54, extending radially from inner or intersection point 76 is channel 94 formed by walls 90 and 92 and terminating in terminal port portion 52*a*. Disposed adjacent wall 90 is inner guide wall 96, while disposed adjacent wall 92 is inner guide wall 98. Extending radially from point 76 is channel 104 formed by walls 100 and 102 and terminating in terminal port portion 52*b*. Disposed adjacent wall 100 is inner guide wall 106, while disposed adjacent wall 102 is inner guide wall 108. Extending radially from point 76 is channel 114 formed by walls 110 and 112 terminating in terminal port portion 52*c*. Disposed adjacent wall 110 is inner guide wall 118, while disposed adjacent wall 112 is inner guide wall 116. Channels 94, 104, and 114 each form one-half of an enclosed duct when one wafer 48 is axially disposed on another wafer 48, via complementary channel/wall structures on the lower surface of the axially disposed wafer. Terminal port portions 52*a*, 52*b*, and 52*c* form one-half of a terminal port 52 that is sized to receive terminal fittings of an electrical receptacle structure as described below.

Additionally radially extending from point 76 is channel 124 formed by walls 120 and 122, and terminating in wire port portion 50*a*. Radially extending from point 76 is channel 130 formed by walls 126 and 128, and terminating in wire port portion 50*b*. Radially extending from point 76 is channel 136 formed by walls 132 and 134, and terminating in wire port portion 50*c*. Channels 124, 130, and 136 each form one-half of an enclosed duct when one wafer 48 is axially disposed on another wafer 48, via complementary channel/wall structures on the lower surface of the axially disposed wafer. Wire port portions 50*a*, 50*b*, and 50*c* form one-half of a wire port 50 that is sized to receive wires of an electrical cable as described above.

As indicated above with respect to the various channels of upper surface 54 of one wafer 48 forming ducts with channels of the lower surface 52 of another axially disposed wafer 48, lower surface 56 of wafer 48 is identical in topography to upper surface 54 as described above, with the exception of posts 72*a*–*f*. Instead of posts, lower surface 56 has axial bores 78*a*, 78*b*, 78*c*, 78*d*, 78*e*, and 78*f*, of which only axial bores 78*c*, 78*d*, 78*e*, and 78*f* are depicted, that are respectively coaxial with respective posts 72*a*, 72*b*, 72*c*, 72*d*, 72*e*, and 72*f*. The internal diameter of bores 78*a*, 78*b*, 78*c*, 78*d*, 78*e*, and 78*f* is sized to receive posts 72*a*, 72*b*, 72*c*, 72*d*, 72*e*, and 72*f* and provide an interference fit therewith due to the diameter of respective flanges 74*a*, 74*b*, 74*c*, 74*d*, 74*e*, and 74*f*. Thus, as wafers 48 are stacked one upon another, posts 72*a*, 72*b*, 72*c*, 72*d*, 72*e*, and 72*f* of one wafer are received in an interference fit in bores 78*a*, 78*b*, 78*c*, 78*d*, 78*e*, and 78*f* of another wafer.

Figure 5:
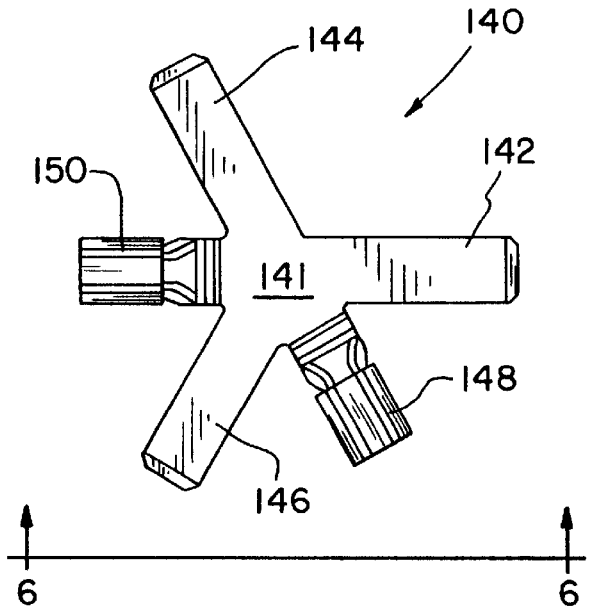
FIG. 5 is a top plan view of an electrical terminal in accordance with the present invention.
Figure 6:
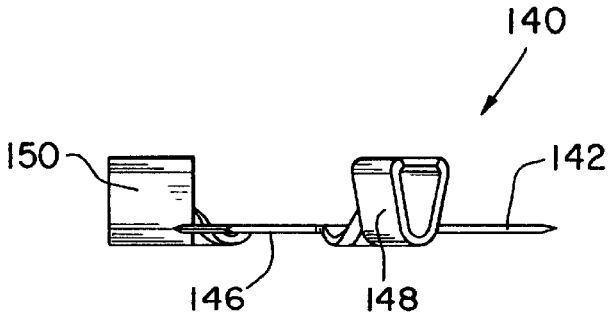
FIG. 6 is a side view of the terminal of FIG. 5 taken along line 6—6 thereof.

With reference to FIGS. 5 and 6 there is shown terminal 140 one of which is situated between each axially adjacent wafer of each terminal block within the ducts formed by the channel halves of the upper and lower surfaces of the axially adjacent wafers. Terminal 140 is formed of an electrically conductive material and has three (3) prongs 142, 144, and 146, and two (2) clips 148 and 150 that each radially extend from common point or middle 141. Clip 148 rests within one of the wire ducts formed by one of the channels 124, 130, and 136 and its complementary channel of the lower surface of an axially adjacent wafer, and is adapted to receive and hold one wire of an electrical cable as is known in the art. Clip 150 rests in another one of the wire ducts formed by another one of the channels 124, 130, and 136 and its complementary channel of the lower surface of an axially adjacent wafer, and is adapted to receive and hold one wire of an electrical cable as is known in the art. Thus, one clip of clips 148 and 150 maintains an incoming wire, while the other clip of clips 148 and 150 maintains an outgoing wire. Prongs 142, 144, and 146 rest within one of the terminal ducts formed by one of the channels 94, 104, and 114 and its complementary channel of the lower surface of an axially adjacent wafer, and are adapted to be coupled to terminals of an electrical receptacle.

Terminal 140 is configured such that it can be rotatably oriented relative to the particular wire ducts desired to be the incoming and the outgoing wire ducts out of three possible wire ducts. As an example, clip 148 may rest in channel 124 which orients terminal 140 such that clip 150 rests in channel 136. Clip 148 could also rest in channel 130 which orients clip 150 into channel 124. The last situation is where clip 148 would reside in channel 136 which would orient clip 150 into channel 130. It should be apparent that no matter how terminal 140 is oriented, one of prongs 142, 144, and 146 always rests in a terminal duct. Further, as indicated above, any terminal 140 can accept and distribute any polarity or neutral wire to the receptacle as long as the receptacle is configured appropriately.

Figure 7:
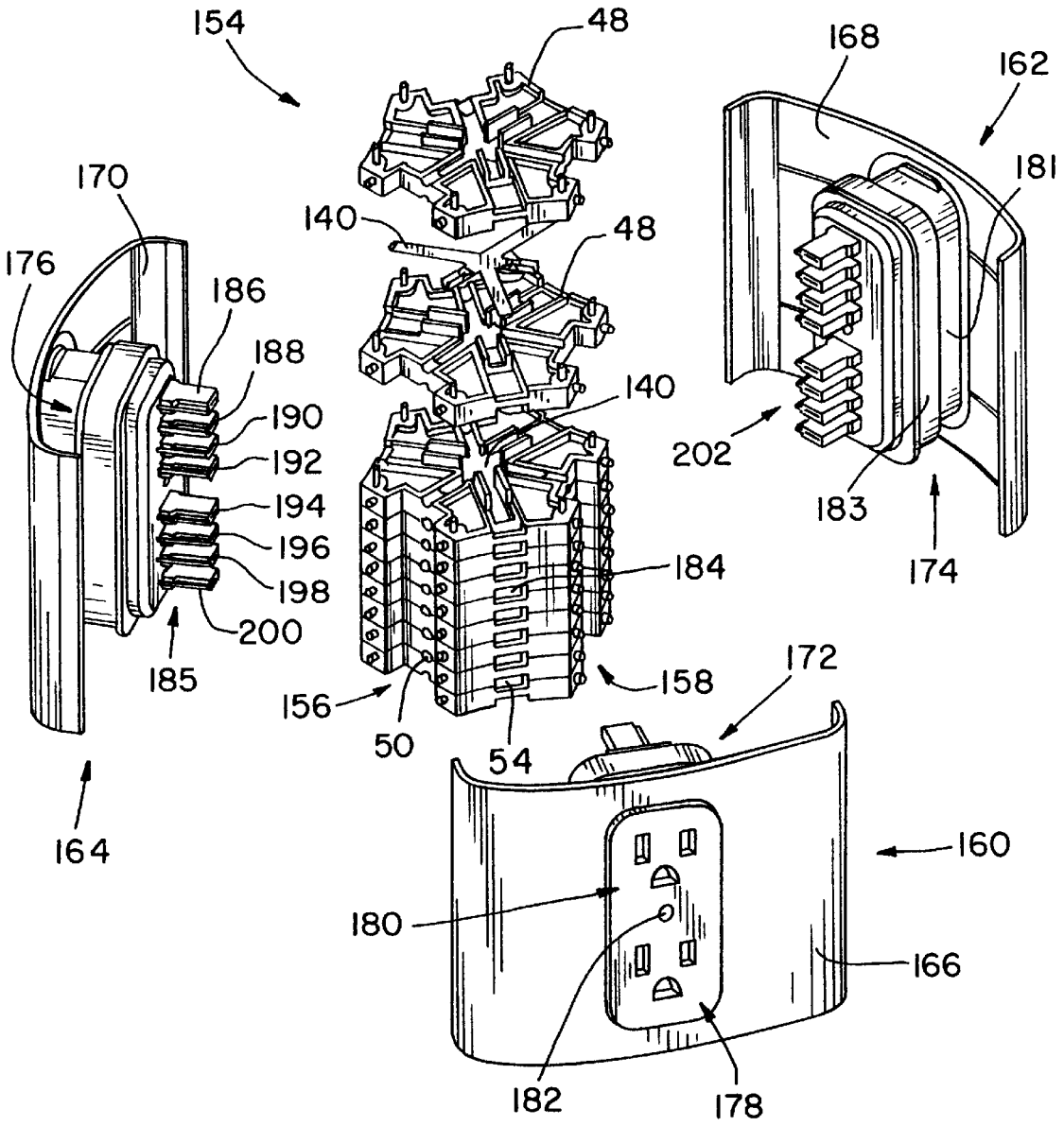
FIG. 7 is an exploded perspective view of a three receptacle terminal block.

With reference now to FIG. 7, there is shown a partially exploded view of a terminal block 154 depicting how wafers 48 stack or are axially adjacent one another with a terminal 140 disposed between each axially adjacent wafer. Again, the post and bore configuration of the wafers provides an interference fit to retain the wafers in stacked relationship to one another. The terminals 140 are arbitrarily oriented such that any incoming or outgoing wire utilizes either the wire ports 50 on faces or columns 156 and 158 which are recessed relative to the side of the wafer. The recess feature allows room for the electrical cable to vertically enter and exit the terminal block without interference.

Couplable to terminal block 154 are three (3) electrical receptacle assemblies 160, 162, and 164 each having a respective curved face plate 166, 168, and 1 70 that each retain an outlet assembly 172, 174 and 176. Each outlet assembly 172, 174, and 176 has two outlets, of which only outlets 178 and 180 of outlet assembly 172 can be seen, and are coupled to the terminal block by a screw or the like (not shown) extending through screw hole 182 and into a screw receptacle, of which only screw receptacle 184 can be seen. Screw receptacle 184 is disposed between two of the wafers within the terminal ducts rather than a terminal.

Each electrical outlet assembly 172, 174, and 176 has a terminal bank, with terminal banks 185 and 202 of outlet assemblies 176 and 174 respectively shown. Terminal bank 185 consists of eight (8) receptacle terminals 186, 188, 190, 192, 194, 196, 198, and 200 that provide electrical communication to an outlet hole of the receptacle. When a prong of a terminal block terminal (140) is coupled to the receptacle terminals, electricity can flow to the outlet holes. Each receptacle terminal 186, 188, 190, 192, 194, 196, 198, and 200 is received in a terminal port 52 of the terminal block 154 wherein a prong of a terminal (140) is disposed. Terminal bank 202 and the terminal bank of outlet assembly 172 is identical to terminal bank 185. As there are three (3) columns of terminal ports 52 to terminal block 154, so are there three (3) receptacle assemblies 160, 162, and 164.

Figure 8:
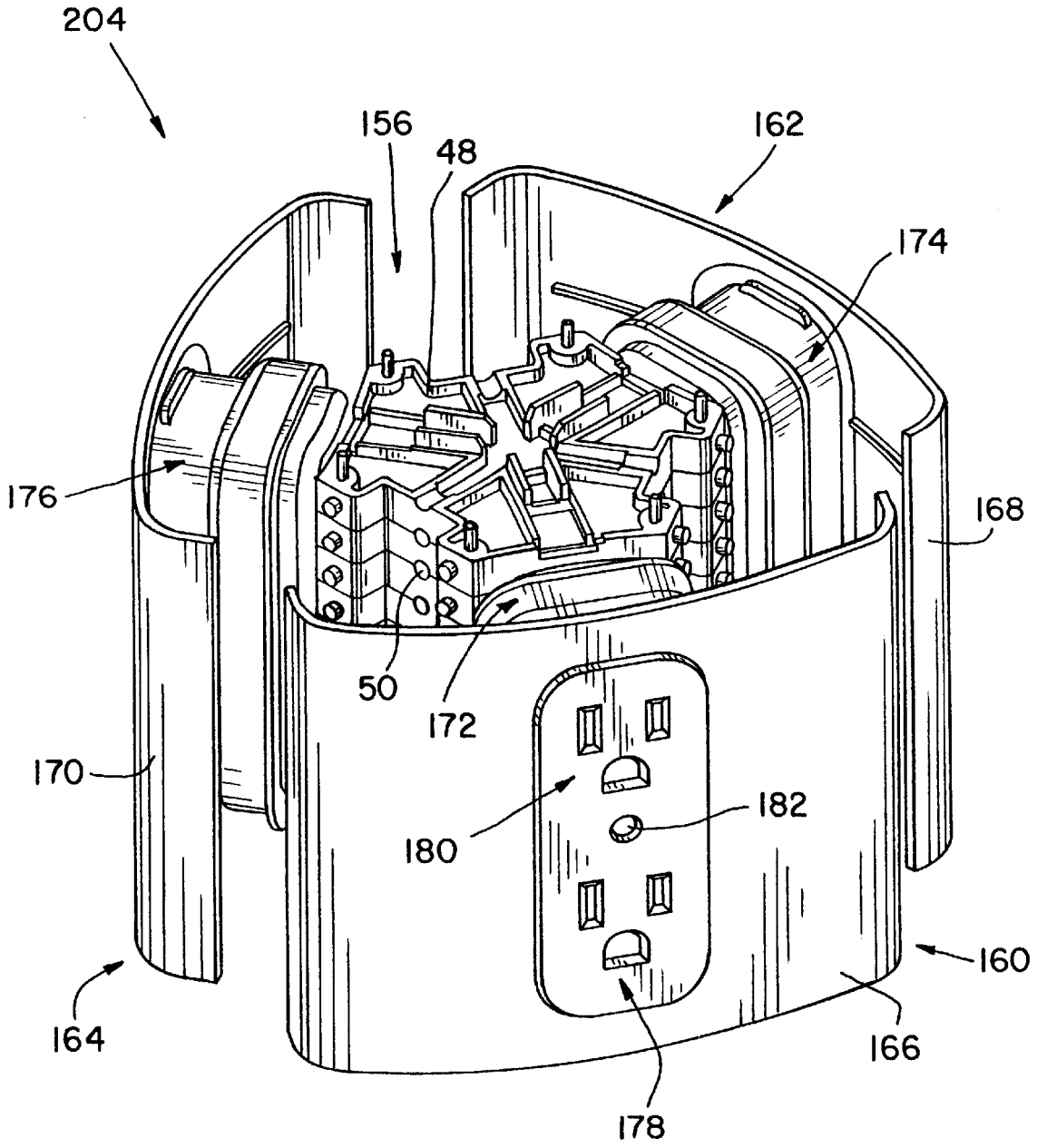
FIG. 8 is a perspective view of the three receptacle terminal block of FIG. 7 in an assembled state.

FIG. 8 depicts an enlarged, assembled terminal block/electrical receptacles structure 204 made in accordance with the above principles especially as depicted in FIG. 7.

Figure 9:
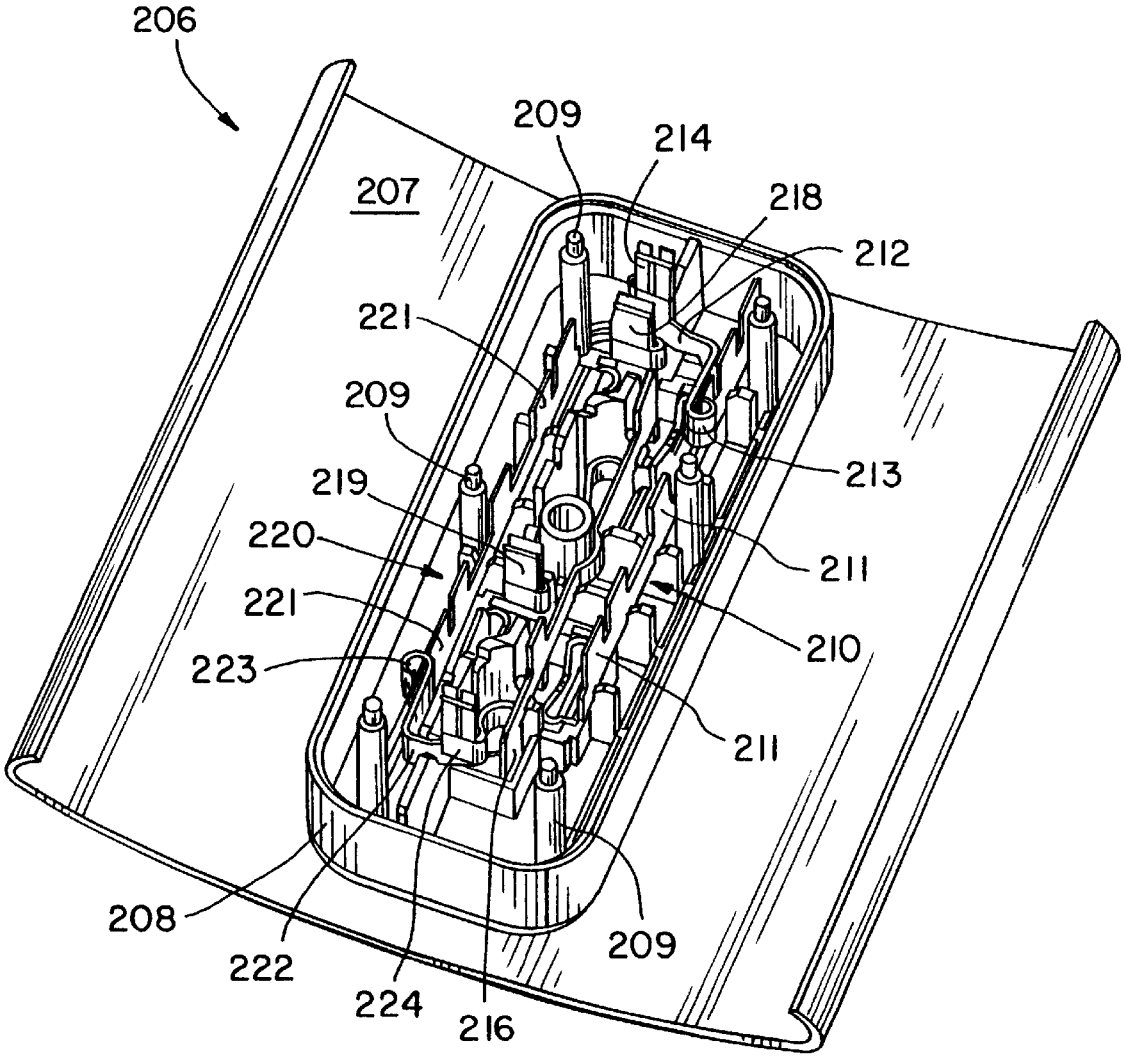
FIG. 9 is a rear perspective view of an electrical receptacle in accordance with an aspect of the present invention.

With reference now to FIG. 9, there is shown a rear view of electrical receptacle assembly 206 which is identical to electrical receptacle assemblies 160, 162, and 164 depicted in FIGS. 7 and 8. Electrical receptacle assembly 206 includes face plate 207 and electrical outlets on the side opposite that shown. Extending from face plate 207 is oval-shaped wall 208. Interior of wall 208 are a plurality of posts 209 that together support a cover (not shown) associated with a corresponding terminal bank thereof In FIG. 7, this aspect is best seen with reference to receptacle assembly 162. Receptacle assembly 162 includes face plate 168 having oval-shaped wall 181 with interior posts (not seen) that support cover 183 of outlet assembly 174 and terminal bank 202. Referring back to FIG. 9, disposed interior of wall 208 is a first conductor strip or bar 210 that is supported therein by a plurality of insulating stands. Conductor 210 has a plurality of supports 211 each of which is adapted to support terminal member 212. Terminal member 212 includes curved attachment end 213 adapted to be received on one of the supports 211, and clip end 214 adapted to become/couple with the corresponding terminal bank. Terminal member 212 may be placed on any one of the plurality of supports along conductor 210. Several terminal members may be used and supported on conductor 210 and carry one polarity of electricity or ground. Also disposed interior of wall 208 is second conductor strip or bar 216 that is supported therein by a plurality of insulating stands. Conductor 216 includes first clip 218 at one end and second clip 219 that carries a second polarity or of electricity or ground. Conductor 220 has a plurality of supports 221 each of which is adapted to support terminal member 222. Terminal member 222 includes curved attachment end 223 adapted to be received on one of the supports 221, and clip end 224 adapted to become/couple with the corresponding terminal bank. Terminal member 222 may be placed on any one of the plurality of supports along conductor 220. Several terminal members may be used and supported on conductor 220 and carry one polarity of electricity or ground. Also disposed interior of wall 208 is second conductor strip or bar 216 that is supported therein by a plurality of insulating stands. Conductor 216 includes first clip 218 at one end and second clip 219 that carries a second polarity or of electricity or ground. Conductor 220 has a plurality of supports 221 each of which is adapted to support terminal member 222. Terminal member 222 includes curved attachment end 223 adapted to be received on one of the supports 221, and clip end 224 adapted to become/couple with the corresponding terminal bank. Terminal member 222 may be placed on any one of the plurality of supports along conductor 220. Several terminal members may be used and supported on conductor 220 and carry one polarity of electricity or ground.

The use of conductor strips or bars and movable terminals allows variation in the configuration of the outlet from the terminal block as well as the number of polarity wires. For example, such a receptacle allows for the use of 3—3-2 (three line, three neutral, and two ground) type wiring or other wiring, without having to have dedicated conductors for the differently configured receptacles.

Additionally, while not shown in the Figures, a cap may be placed on either or both of the top and bottom wafers, the cap having a complementary topography on one surface thereof to form the necessary ducts. The other surface thereof would not have such topography.

Further, it should be appreciated that the wafers may be made with more or less sides to accommodate more or less electrical receptacles and/or more or less incoming/outgoing wires. The terminal between the wafers would be easily modifiable to have more or less prongs and/or clips. Also, receptacles having more or less than two outlets is attainable.

It should also be recognized that while the present invention has been described and shown as applicable to vertical members associated with furniture, the present invention may be used for other applications where electrical outlets are needed in whatever orientation and thus is not limited to vertical posts, particular types or pieces of furniture, or even furniture.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution assembly, comprising:

a plurality of stacked wafers, each said wafer made from an electrically insulating material, adjacent wafers defining a plurality of ducts therebetween;

a plurality of distribution terminals, at least one of said distribution terminals disposed between two adjacent said stacked wafers, each said distribution terminal having an input terminal couplable to an electrical wire and at least one outlet terminal, said input terminal and said at least one outlet terminal disposed in said ducts; and an electrical receptacle assembly having a plurality of input terminals, each said input terminal of said electrical receptacle assembly selectively coupled with a corresponding said outlet terminal of a corresponding said distribution terminal.

2. The electrical distribution assembly of claim 1, further comprising a plurality of electrical receptacle assemblies each having a plurality of input terminals, each said input terminal of each said electrical receptacle assemblies coupled with a corresponding said outlet terminal of a corresponding said distribution terminal.

3. The electrical distribution assembly of claim 1, wherein each wafer has a plurality of posts on one of an upper and lower surface, and a plurality of bores in one of another of said upper and lower surfaces, wherein each one of said plurality of posts is adapted to be received in one of each of said plurality of bores.

4. The electrical distribution assembly of claim 3, wherein said posts have a given post diameter, said bores have a given bore diameter, and wherein said given post diameter is larger than the given diameter of said bores to provide an interference fit therebetween.

5. The electrical distribution assembly of claim 4, wherein each of said posts includes at least two outwardly extending projections providing said interference fit with said corresponding bores.

* * * * *